United States Patent [19]

McGhee

[11] Patent Number: 4,654,900

[45] Date of Patent: Apr. 7, 1987

[54] BATHTUB VALVE FIXTURE MODULE

[76] Inventor: Charles M. McGhee, 2319 Cardigan, Memphis, Tenn. 38119

[21] Appl. No.: 800,397

[22] Filed: Nov. 21, 1985

[51] Int. Cl.[4] ..... E03C 1/00; E03C 1/04

[52] U.S. Cl. ..... 4/191; 4/192; 4/661

[58] Field of Search ..... 4/191, 192, 661, 605, 4/193, 195, 559, DIG. 15; 137/360, 359, 361, 350, 357

[56] References Cited

U.S. PATENT DOCUMENTS

| | | | |
|---|---|---|---|
| 2,320,477 | 6/1943 | Souther | 137/360 X |
| 2,930,505 | 3/1960 | Meyer | 4/661 X |
| 3,110,038 | 11/1963 | Dornbierer | 4/191 |
| 3,175,575 | 3/1965 | Kennedy | 137/360 |
| 3,609,774 | 10/1971 | Allgood | 4/191 |
| 3,718,154 | 2/1973 | Doumany | 137/360 |
| 3,733,622 | 5/1973 | Searles | 4/191 |
| 4,167,196 | 9/1979 | Morris | 137/360 |
| 4,410,004 | 10/1983 | Kifer et al. | 137/360 |
| 4,572,232 | 2/1986 | Gruber | 4/192 |

FOREIGN PATENT DOCUMENTS

| | | | |
|---|---|---|---|
| 2462138 | 3/1981 | France | 4/191 |
| 2499842 | 8/1982 | France | 4/661 |

*Primary Examiner*—Henry K. Artis

*Attorney, Agent, or Firm*—Walker & McKenzie

[57] ABSTRACT

The faucets and associated faucet structure of a bathtub assembly are mounted on a cover plate which is, in turn, hingably and slidably attached to a frame member which is secured to wall structure adjacent the normal location of the faucets. Flexible connecting lines extend between the faucet structure and water supply lines. To repair or replace the faucets and/or associated faucet structure, the plate member is first pulled away from the wall and then pivoted to allow access to the faucets and associated faucet structures.

10 Claims, 14 Drawing Figures

BATHTUB VALVE FIXTURE MODULE

BACKGROUND OF THE INVENTION

The present invention relates in general to means for improving the accessibility of the faucets and associated faucet structure of a bathtub assembly.

It is often necessary to repair or replace the faucets and associated faucet structure of a bathtub assembly. Bathtubs have, in the past, been positioned so that the faucets and associated faucet structure are accessible from an access panel located in an adjacent room, closet or the like. However, such access panels are sometimes considered detrimental to the adjacent room, closet or the like and builders often omit the access panel in newly constructed homes, motels and the like. In such a case, repair or replacement of the faucets and associated faucet structure might require tile and/or other wall structure adjacent the faucets to be removed thus requiring an expensive repair to the wall structure once the faucets and/or associated faucet structure have been repaired or replaced.

A preliminary patentability search in class 137, subclass 360 and class 4, subclasses 191 and 192 disclosed the following patents: Tortorice, U.S. Pat. No. 2,824,312; Togni, U.S. Pat. No. 3,221,454; Searles, U.S. Pat. No. 3,733,622; Doumany, U.S. Pat. No. 3,831,624; Anderson, U.S. Pat. No. 3,847,175; Morris, U.S. Pat. No. 4,167,196; and Petty, U.S. Pat. No. 4,403,355. None of the above patents disclose or suggest the present invention.

SUMMARY OF THE INVENTION

The present invention provides means for allowing access to the faucets and associated faucet structure of a bathtub assembly without requiring removal of tile or other wall covering adjacent the faucets and associated faucet structure and without requiring an access panel to be located in an adjacent room, closet or the like.

The bathtub valve fixture module of the present invention includes, in general, an elongated, flexible hot water connecting line attached to the hot water supply conduit; an elongated, flexible cold water connecting line attached to the cold water supply conduit; a valve fixture means attached to the hot and cold water connecting lines for controlling the flow of hot and cold water to a bathtub assembly; a plate member attached to the valve fixture means; a slide means slidably attached relative to wall structure for movement between an in position and an out position; and hinge means attached to the plate member and to the slide means for allowing the plate member to pivot between a closed position and an opened position when the slide means is in the out position.

One objective of the present invention is to allow a frame to be installed at the appropriate location in wall structure adjacent a bathtub assembly during the construction stage of a house, motel or the like and to allow a plumbing contractor to install the plate means with the plumbing fixtures attached thereto at a later date whereby the plumbing fixtures will not be damaged during the construction stage of a house, motel or the like and whereby the plumbing contractor will not damage the wall structure when installing the plumbing fixtures.

Another objective of the present invention is to allow the bathtub faucets and associated faucet structure to be easily repaired or replaced without damage to the wall structure and without requiring an access panel to be located in an adjacent room or the like.

DESCRIPTION OF THE PREFERRED EMBODIMENTS

Figure 1:
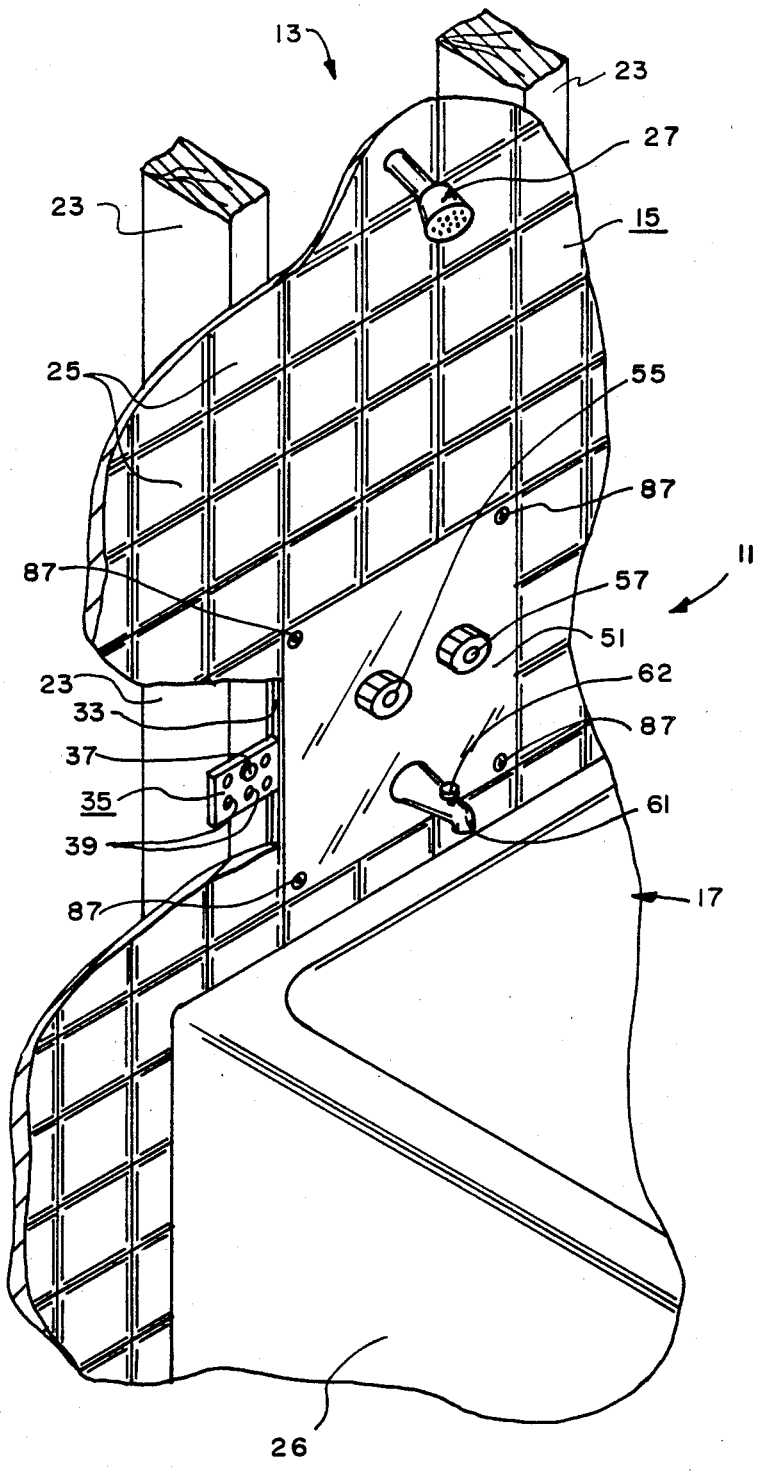
FIG. 1 is a perspective view of a bathtub assembly showing adjacent wall structure and including the module of the present invention.
Figure 8:
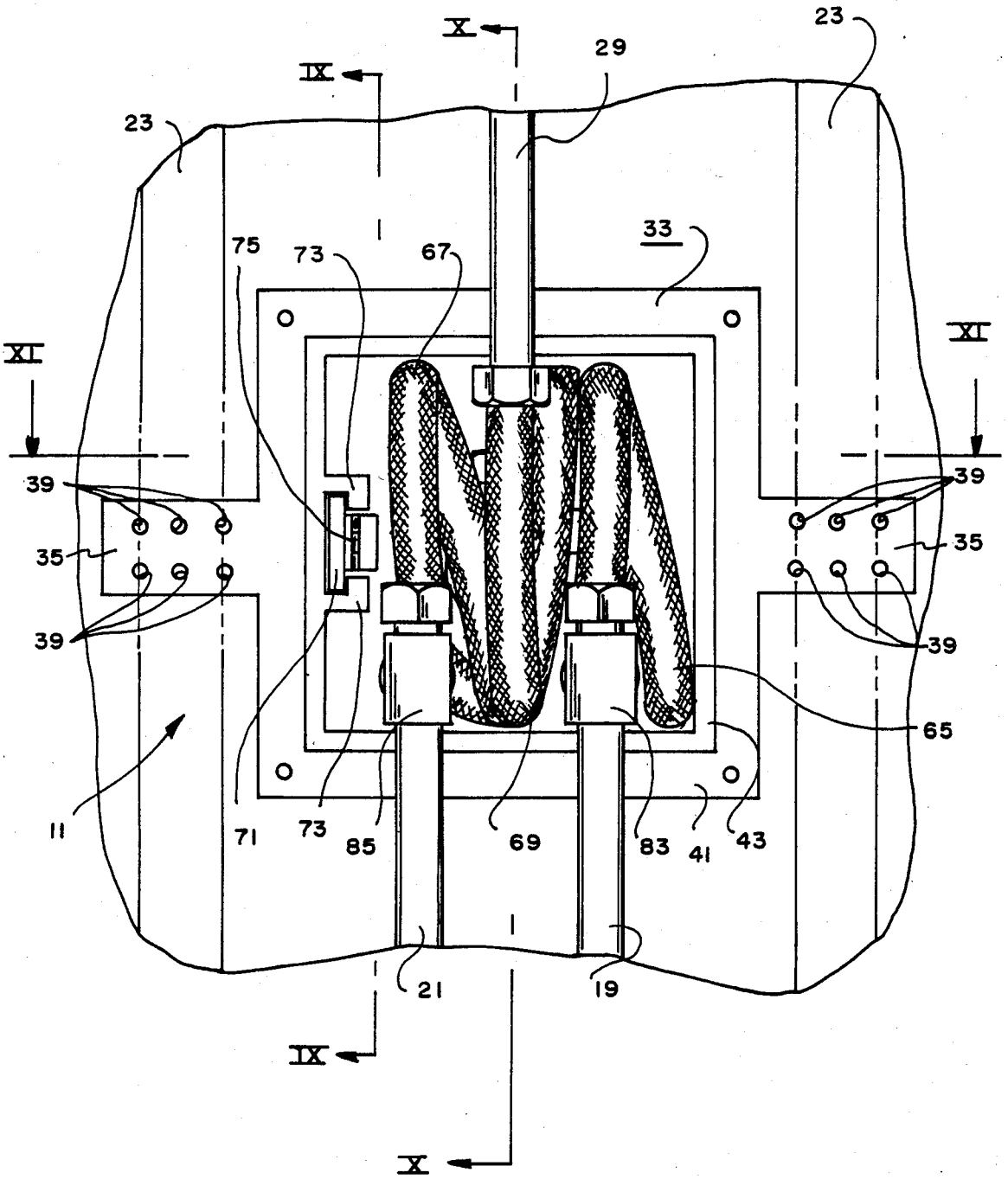
FIG. 8 is a rear elevational view of the module of the present invention shown with the wall structure and bathtub assembly.
Figure 9:
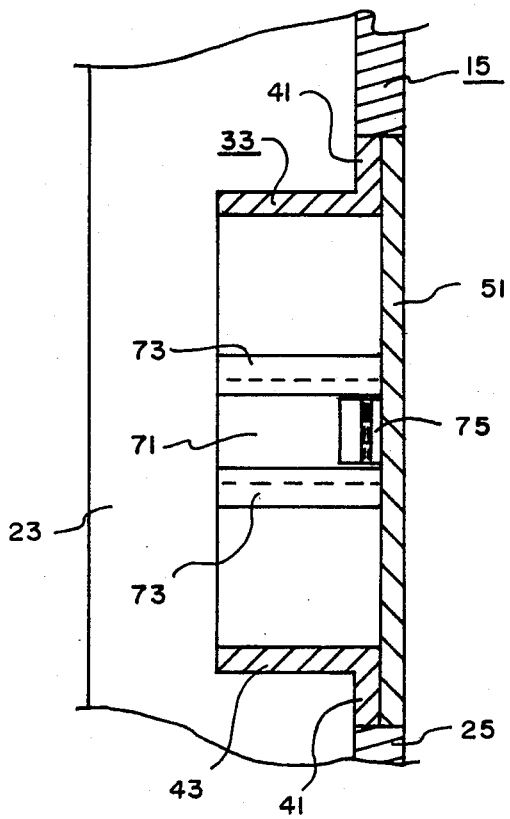
FIG. 9 is a sectional view substantially as taken on line IX—IX of FIG. 8.
Figure 10:
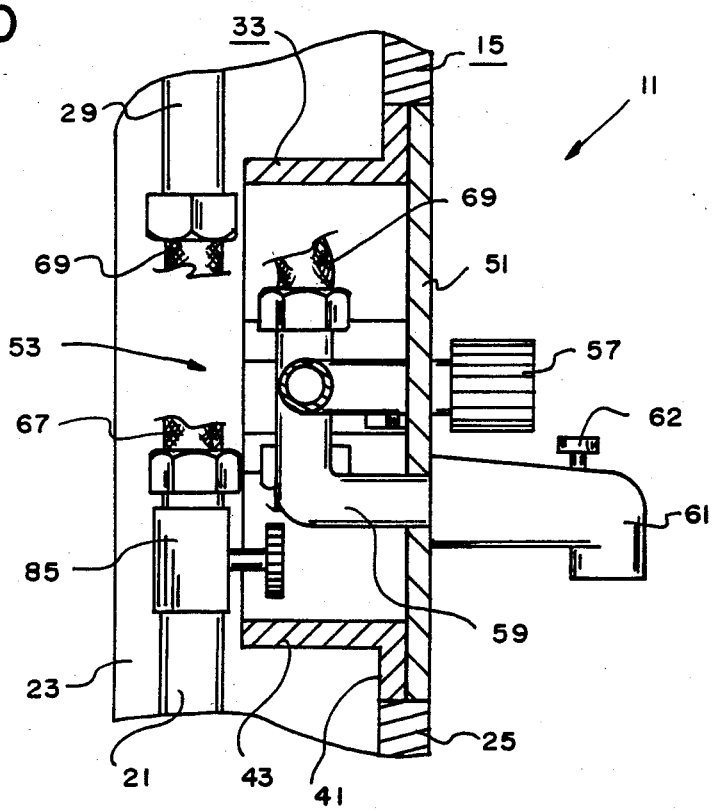
FIG. 10 is a sectional view substantially as taken on line X—X of FIG. 8 with portions thereof broken away for clarity.

The bathtub valve fixture module 11 of the present invention is for attachment within a cavity 13 in wall structure 15 adjacent a bathtub assembly 17 (see, in general, FIG. 1) and for being coupled to a hot water supply conduit 19 and a cold water conduit 21 (see, in general, FIG. 8). The wall structure 15 may be of any typical type including studs 23 and tile 25 or the like for covering the wall about the cavity 13. The bathtub assembly 13 includes a typical bathtub member 26 and preferably includes a shower head 27 and a shower head supply conduit 29.

Figure 2:
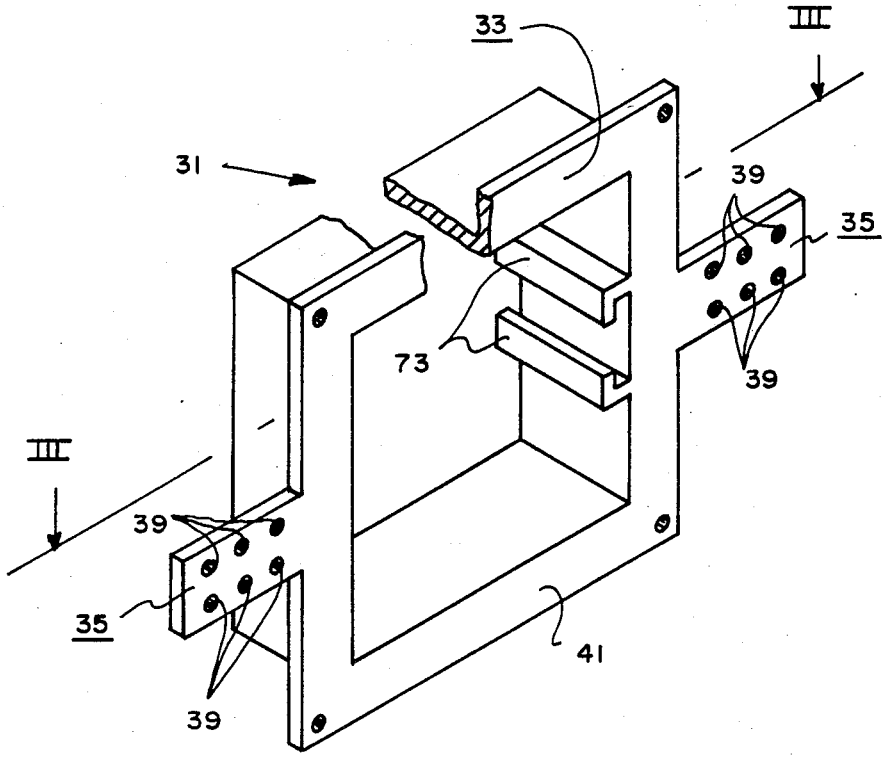
FIG. 2 is a perspective view of the frame member of the module of the present invention with a portion being broken away for purposes of illustration.
Figure 3:
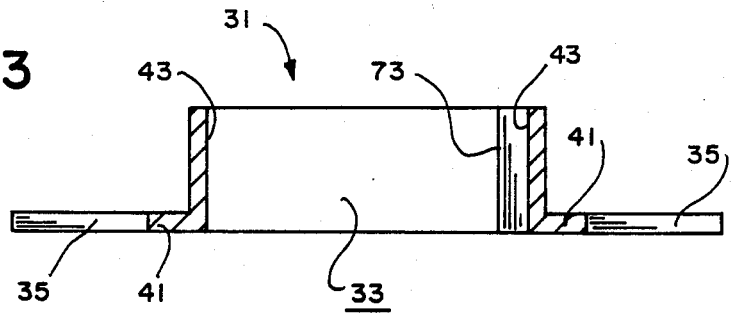
FIG. 3 is a sectional view as taken on line III—III of FIG. 2.
Figure 4:
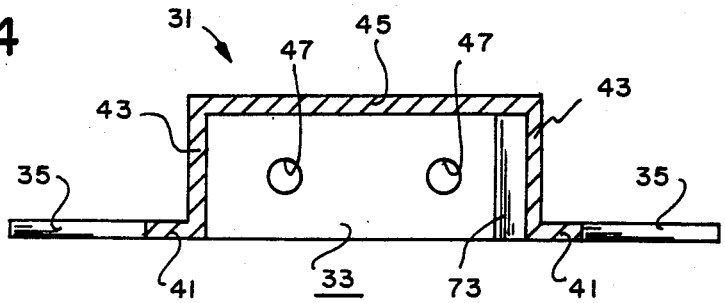
FIG. 4 is a sectional view similar to FIG. 3 but showing an alternate embodiment of the frame member.

The module 11 preferably includes a frame member 31 (see, in general, FIG. 2) for being fixedly attached to the wall structure 15 adjacent the cavity 13. The frame member 31 may consist of an open, rectangular body 33 having a shape and size for fitting into the cavity 13 (i.e., for fitting between a pair of studs 23) and may include a pair of ears 35 or the like extending outward from the body 33 for allowing the body 33 to be fixedly attached to two adjacent studs 23 by way of nails 37 or the like (see, in general, FIG. 1). The ears 35 may have a plurality of spaced apart apertures 39 therethrough for receiving the nails 37 and for allowing adjustment of the frame member 31 relative to the studs 23 to insure that the frame member 31 can be fixedly attached to the studs 23. The body 33 of the frame member 31 may include a face portion 41 and a shoulder portion 43 attached to the face portion 41 at a right angle thereto and extending rearwardly therefrom. An optional embodiment (see FIG. 4) of the body 33 of the frame member 31 may include a back portion 45 attached to the shoulder portion 43 whereby the body 33 of the frame member 31 defines a box for being positioned within the cavity 13. The hot and cold water supply conduits 19, 21 and the shower head supply line 29 are preferably fixed relative to the frame member 31. Thus, for example, the hot and cold water supply conduits 19, 21 and the shower head supply line 29 may be secured to the studs 23 adjacent the frame member 31 in any manner as will be apparent to those skilled in the art. On the other hand, the shoulder portion 43 of the body 33 of the frame member 31 may be provided with apertures 47 (see FIG. 4) through which the hot and cold water supply conduits 19, 21 and the shower head supply line 29 may extend and thus be fixedly secured relative thereto as will now be apparent to those skilled in the art.

Figure 11:
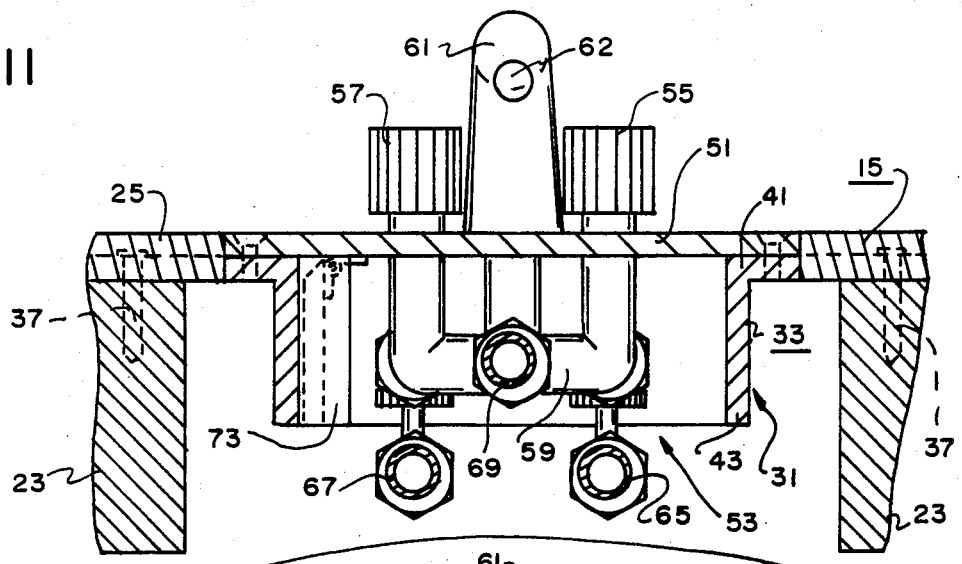
FIG. 11 is a sectional view substantially as taken on line XI—XI of FIG. 8 with portions thereof removed for clarity.
Figure 14:
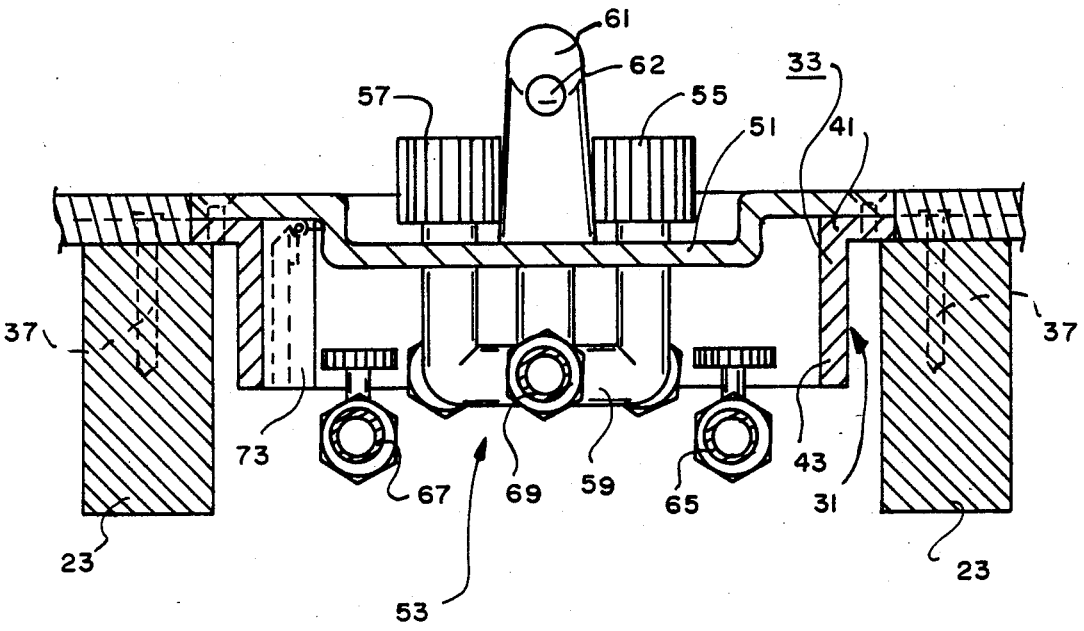
FIG. 14 is a sectional view similar to FIG. 11 but showing an alternate embodiment of the cover plate and associated components thereof.

The module 11 includes a cover plate 51 for covering the mouth of the cavity 13. The cover plate 51 may be sized so as to cover the frame member 31 (see FIG. 11). The cover plate 51 is preferably constructed of metal or the like and may be of any various decorative finishes such as, for example, satin, chrome, antique gold, bright brass, etc. The cover plate 51 may consist of a flat, plate-like member to fit substantially flush with the wall structure 15 (see FIG. 11) or may have a recessed center to fit within the cavity 13 (see FIG. 14).

Figure 13:
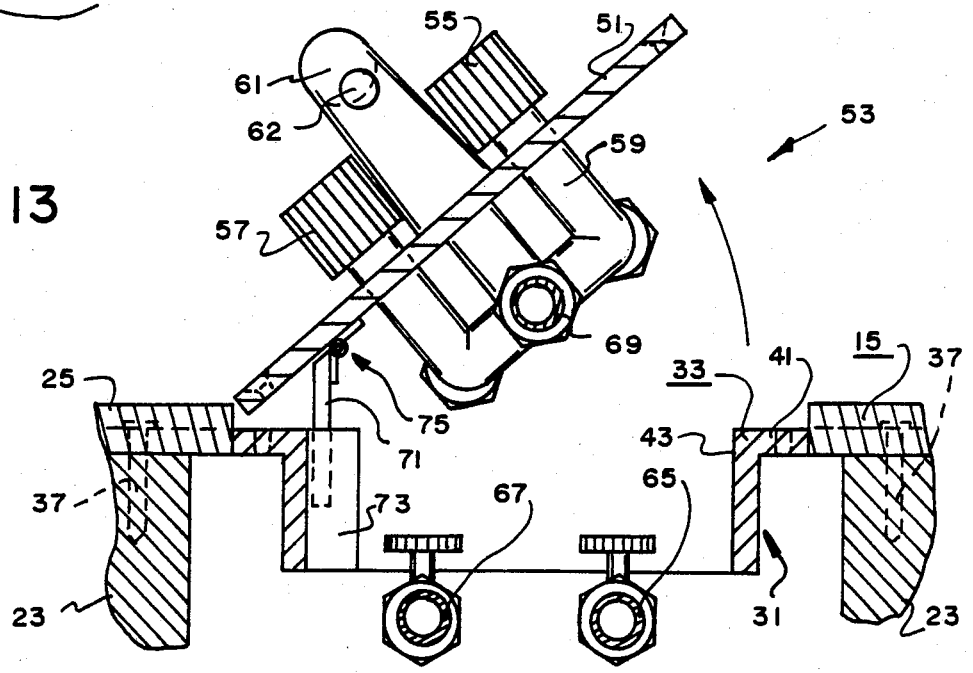
FIG. 13 is a sectional view similar to FIGS. 11 and 12 but with certain components thereof in a moved position.

The module 11 includes a valve fixture means 53 attached to the cover plate 51 (see, in general, FIG. 13). The valve fixture means 53 may be of any typical construction well known to those skilled in the art. Thus, the valve fixture means 53 preferably includes hot and cold water faucet means for regulating the flow of hot and cold water to the bathtub assembly 17. The hot and cold water faucet means may consist of a single valve means as is well known to those skilled in the art or may consist of a separate hot water faucet member 55 and a separate cold water faucet member 57. The valve fixture means 53 also typically includes a manifold member 59 attached to the hot and cold water faucet members 55, 57 and to the hot and cold water supply conduits 19, 21. The manifold member 59 may be of any typical construction well known to those skilled in the art such as an integral, one-piece molding or the like. The valve fixture means 53 also typically includes a nozzle or spout member 61 attached to the manifold member 59 in such a manner that hot and cold water will flow therefrom into the bathtub member 26 when the hot and cold water faucet members 55, 57 are opened. The valve fixture means 53 also typically includes a diverter valve 62 for selectively diverting water from the spout member 61 to the shower head supply conduit 29. The diverter valve 62 may be constructed as part of the spout member 61. The hot and cold water faucet members 55, 57, manifold member 59, spout member 61 and diverter valve 62 are fixedly attahced to the cover plate 51 in an appropriate manner as will be apparent to those skilled in the art. The cover plate 51 preferably includes apertures 64 for receiving the various components of the valve fixture means 53.

Figure 7:
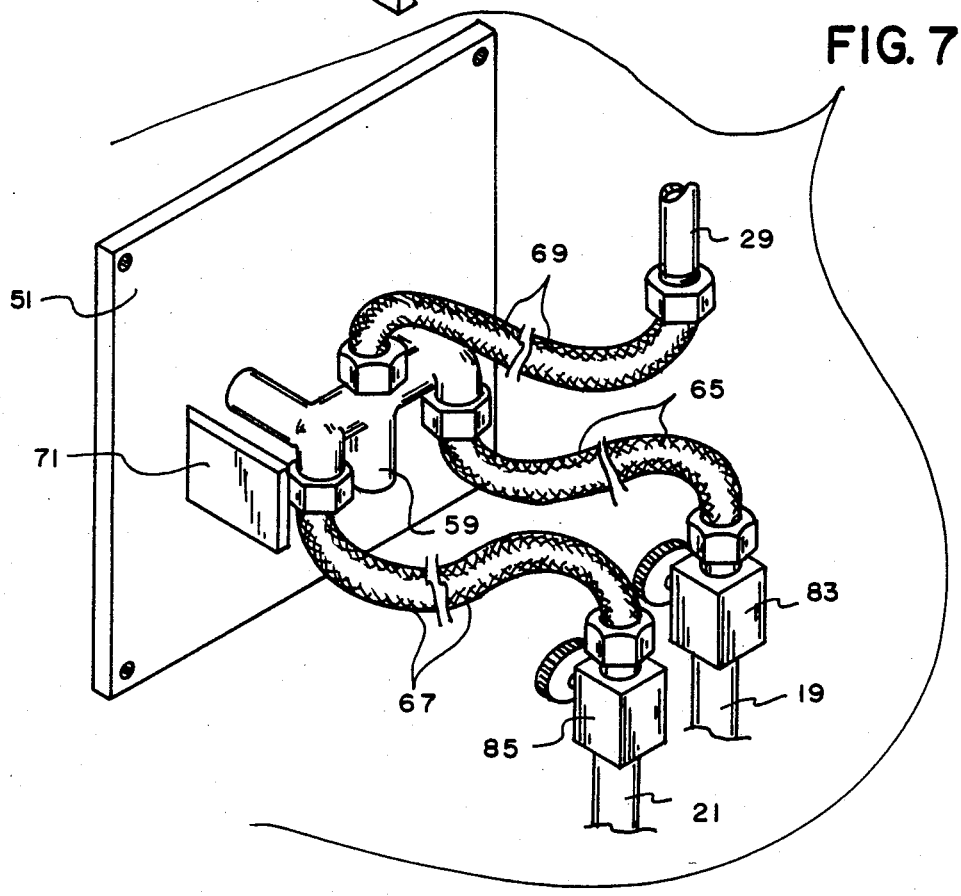
FIG. 7 is a perspective view of the components of FIG. 5 shown with the valve fixture means, connecting lines and cut-off means of the module of the present invention and the water supply conduits of the bathtub assembly.

The module 11 includes an elongated, flexible hot water connecting line 65 attached to the hot water supply conduit 19 and to the manifold member 59, and includes an elongated, flexible cold water connecting line 67 attached to the cold water supply conduit 21 and to the manifold member 59 (see, in general, FIG. 7). The module 11 preferably includes an elongated, flexible shower head connecting line 69 attached to the shower head supply line 29 and to the manifold member 59 (see, in general, FIG. 7). The flexible connecting lines 65, 67, 69 allow movement of the valve fixture means 53 and cover plate 51 relative to the fixed ends of the hot and cold water supply conduits 19, 21 and the shower head supply conduit 29.

Figure 12:
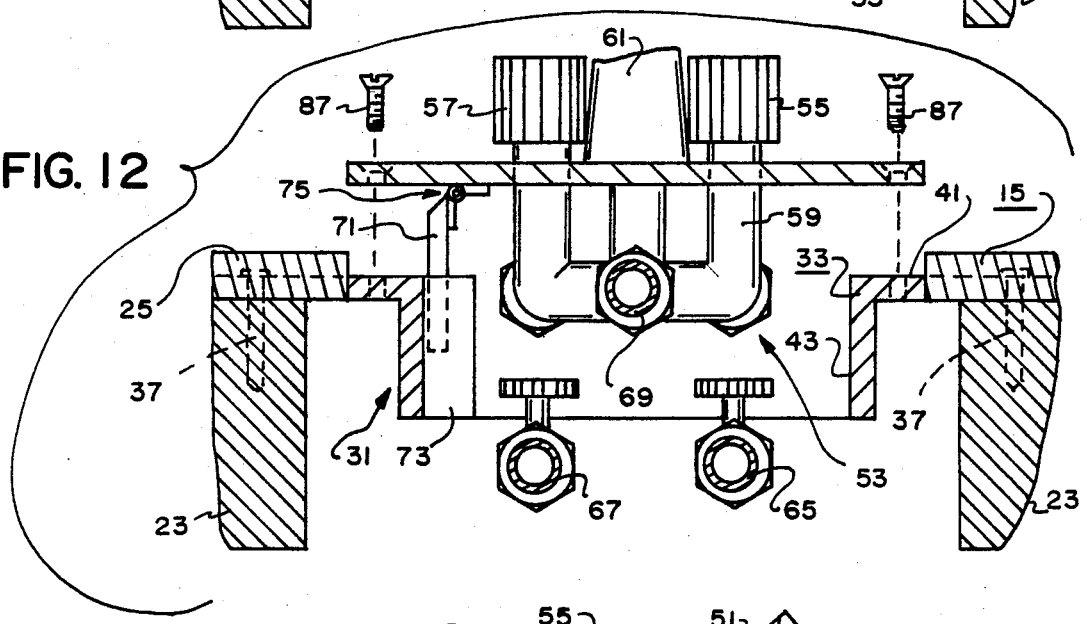
FIG. 12 is a sectional view similar to FIG. 11 but with certain components thereof in a moved position.

The module 11 includes a slide means 71 slidably attached relative to the wall structure 15 for movement between an in position (see FIG. 11) and an out position (see FIG. 12). The slide means 71 is preferably slidably attached to the shoulder portion 43 of the body 33 of the frame member 31. Thus, the frame member 31 may include a bracket means preferably consisting of a pair of opposed, spaced apart bracket members 73 attached to the shoulder portion 43 (see, in general, FIG. 2) so as to define a track or the like for slidably receiving the slide means 71 which may consist simply of a rectangular metal plate or the like.

Figure 5:
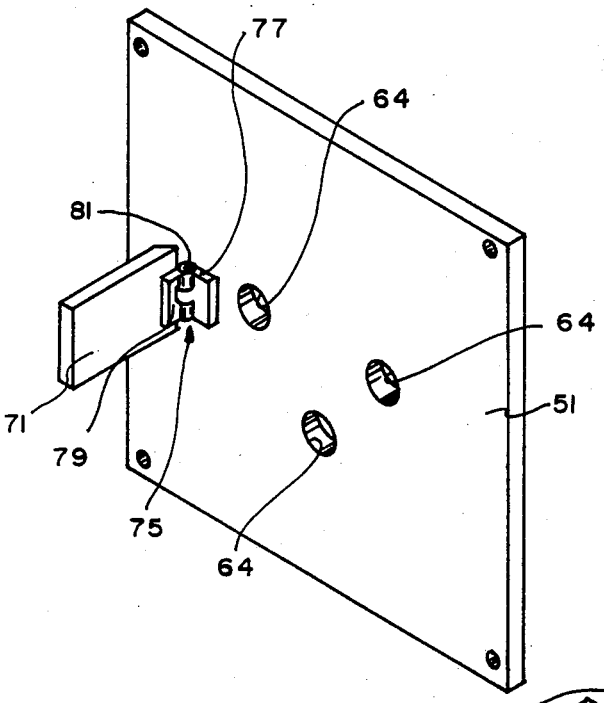
FIG. 5 is a perspective view of the cover plate, slide means and hinge means of the module of the present invention.
Figure 6:
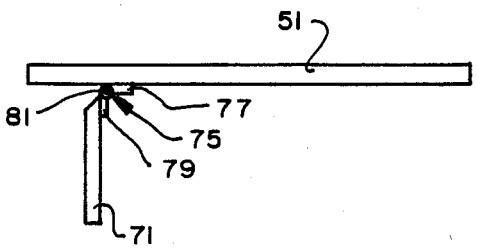
FIG. 6 is a top plan view of the components of FIG. 5.

The module 11 includes hinge means 75 attached to the cover plate 51 and to the slide means 71 (see, in general, FIG. 5) for allowing the cover member 51 to pivot between a closed position (see FIGS. 11 and 12) and an opened position (see FIG. 13) when the slide means is in the out position. The hinge means 75 may be of any typical construction well known to those skilled in the art. Thus, the hinge means 75 may include a first member 77 fixedly attached to the cover plate 51 as by being welded thereto or the like, a second member 79 fixedly attached to one end of the slide means 71 as by being welded thereto or the like, and means 81 to pivotally join the first and second members 77, 79 to one another.

The module 11 may include hot and cold water cut-off valve means 83, 85, respectively, attached relative to the hot and cold water supply conduits 19, 21 (see, in general, FIG. 7) for cutting off the flow of hot and cold water to the hot and cold water faucet members 55, 57, respectively.

Screws 87 or the like (see FIG. 1) may be provided to secure the cover plate 51 relative to the wall structure 15.

The specific construction of the various components of the module 11 may vary as will now be apparent to those skilled in the art. Thus, the frame member 31, cover plate 51 and slide means 71 may be constructed of a substantially rigid, non-corrosive metal or the like; the valve fixture means 53, hinge means 75, and cut-off valve means 83, 85 may consist of off-the-self components as will be apparent to those skilled in the art, and the flexible connecting lines 65, 67, 69 may consist of off-the-self flexible plumbing conduit as will be apparent to those skilled in the art.

The module 11 may be typically supplied in two pieces, the frame member 31 comprising one piece and the cover plate 51 with the hinge means 75, the slide means 71, the valve fixture means 53 and the flexible connecting lines 65, 67, 69 attached thereto comprising the second piece. The frame member 31 is typically installed at the job site during the initial construction stage at which time the cut-off valve means 83, 85 would be coupled to the supply conduits 19, 21. The valve fixture means 53 and flexible connecting lines 65, 67, 69 may be attached to the cover plate 51 either at the job site or off premises. Once the construction stage is substantially complete, the slide means 71 is inserted into the bracket members 73 to support the cover plate 51, valve fixture means 53 and connecting lines 65, 67, 69. The plumbing contractor can then easily connect the connecting lines 65, 67, 69 to the appropriate supply conduits 19, 21, 29. The cover plate 51 is then pivoted to the closed position and moved with the slide means 71 to the in position. Screws 87 or the like can then be used to secure the cover plate 51 in the closed position.

If the valve fixture means 53 or plumbing connections prove defective during the initial startup phase or anytime thereafter, the screws 87 can merely be removed (see FIG. 12), the cover plate 51 and slide means 71 moved to the out position (see FIG. 12), and the cover plate 51 pivoted to the open position (see FIG. 13) to thereby allow access to the valve fixture means 53 and plumbing connections. To repair or replace any component, the cut-off means 83, 85 are merely closed so as not to result in any inconvenience to other sections of the house, motel or the like due to shuting down the water supply thereof. The present invention thus allows repair or replacement without costly damage to tile or other wall covering without requiring an access panel to the plumbing fixtures from an adjacent room or the like, and without requiring the water supply to other sections of the house, motel or the like to be shut down. The present invention saves time in the repair or replacement of plumbing fixtures—it is estimated that an old tub faucet can be replaced with a new one in 15 minutes using the present invention with no damage to interior walls or the like. The cover plate 51 may, of course, be offered drilled for 3 valves, 2 valves or single lever faucets as will be apparent to those skilled in the art.

Although the present invention has been described and illustrated with respect to a preferred embodiment thereof and a preferred use therefore, it is not to be so limited since changes and modifications can be made therein which are within the full intended scope of the invention.

I claim:

1. A bathtub valve fixture module for attachment within a cavity in wall structure adjacent a bathtub assembly and for being coupled to a hot water supply conduit and a cold water supply conduit, said module comprising:

(a) an elongated, flexible hot water connecting line attached to said hot water supply conduit;

(b) an elongated, flexible cold water connecting line attached to said cold water supply conduit;

(c) a valve fixture means attached to said hot water connecting line and said cold water connecting line for controlling the flow of hot and cold water to said bathtub assembly;

(d) a cover plate attached to said valve fixture means;

(e) slide means slidably attached relative to said wall structure for movement between an in position and an out position; and (f) hinge means attached to said cover plate and to said slide means for allowing said cover plate to pivot between a closed position and an open position when said slide means is in said out position.

2. The fixture module of claim 1 in which is included a frame member fixably attached to said wall structure, said slide means being slidably attached to said frame member for movement between said in and out positions.

3. The fixture module of claim 2 in which said frame member includes bracket means for slidably receiving said slide means.

4. The fixture module of claim 3 in which said bathtub assembly includes a shower head and a shower head supply conduit; and in which is included an elongated, flexible shower head connecting line attached to said shower head supply conduit and to said valve fixture means.

5. The fixture module of claim 4 in which said valve fixture means includes hot and cold water faucet means for regulating the flow of hot and cold water to said bathtub assembly.

6. The fixture module of claim 5 in which is included hot and cold water cut-off valve means attached to said hot and cold water supply conduits for cutting off the flow of hot and cold water to said hot and cold water faucet means.

7. The fixture module of claim 6 in which said frame means includes a box member for enclosing said cavity within said wall structure.

8. The fixture module of claim 7 in which said box member has a plurality of apertures therethrough for allowing said hot and cold water supply conduits and said shower head supply lines to extend therethrough.

9. The fixture of claim 1 in which said cover plate has a recessed center to fit within said cavity.

10. The bathtub valve fixture module for attachment within a cavity in wall structure adjacent a bathtub assembly and for being coupled to a hot water supply conduit and a cold water supply conduit, said module comprising:

(a) an elongated, flexible hot water connecting line for being attached to said hot water supply conduit;

(b) an elongated, flexible cold water connecting line for being attached to said cold water supply conduit;

(c) a valve fixture means attached to said hot water connecting line and said cold water connecting line for controlling the flow of hot and cold water to said bathtub assembly;

(d) a cover plate attached to said valve fixture means;

(e) a frame member for being fixedly attached to said wall structure adjacent said bathtub assembly,said hot water supply conduit and said cold water supply conduit;

(f) slide means for being slidably attached to said frame member for movement between an in position and an out position; and (g) hinge means attached to said cover plate and to said slide means for allowing said cover plate to pivot when said slide means is in said out position between a closed position and an open position to allow access to said valve fixture means.

* * * * *